United States Patent [19]

Kifferstein

[11] 4,274,673

[45] Jun. 23, 1981

[54] DISPOSABLE ADJUSTABLE HEADREST AND PILLOW

[76] Inventor: Harry P. Kifferstein, 27250 Harvard Rd., Southfield, Mich. 48076

[21] Appl. No.: 947,501

[22] Filed: Oct. 2, 1978

[51] Int. Cl.[3] ..... A47C 7/46; A47G 9/00

[52] U.S. Cl. ..... 297/220; 5/434; 5/437; 297/391

[58] Field of Search ..... 297/220, 221, 222, 406, 297/391, 397; 5/340, 339, 341, 355, 337, 327 R, 434, 442, 490, 489, 488, 437; D6/201

[56] References Cited

U.S. PATENT DOCUMENTS

| | | | |
|---|---|---|---|
| D. 176,758 | 1/1956 | Edmonson | D6/201 |
| 1,372,989 | 3/1921 | Baker | 297/220 |
| 1,540,685 | 6/1925 | Eiband | 5/437 |
| 2,577,595 | 12/1951 | Tobias | 5/442 X |
| 2,908,766 | 10/1959 | Taylor | 297/391 X |
| 2,952,856 | 9/1960 | Ruff | 297/391 X |
| 3,538,508 | 11/1970 | Young | 5/337 X |
| 3,578,383 | 5/1971 | Earl | 297/391 |
| 3,654,059 | 4/1972 | Zisblatt | 297/220 |
| 3,924,282 | 12/1975 | Bond | 5/327 R |
| 4,015,542 | 4/1977 | Gutridge et al. | 297/220 X |
| 4,042,278 | 8/1977 | Jensen | 5/434 |
| 4,097,086 | 6/1978 | Hudson | 297/391 X |

FOREIGN PATENT DOCUMENTS

| | | | |
|---|---|---|---|
| 25828 | of 1910 | United Kingdom | 5/339 |
| 14561 | of 1913 | United Kingdom | 5/437 |

*Primary Examiner*—James T. McCall
*Attorney, Agent, or Firm*—Hauke and Patalidis

[57] ABSTRACT

A disposable adjustable headrest which can be used either as a headrest, a pillow or a cushion. According to one aspect of the invention, at least a pair of pillow units are placed in a common pillowcase. The pillow units are preferably elongated, made of resilient material and disposed in the common pillowcase at a manually adjustable distance from each other. When disposed an appropriate distance away from each other in the common pillowcase there is formed a convenient headrest supporting both sides of the back of the head of a person sitting in a chair and having placed the pillowcase against the front of the seat back or, when the pillow units are disposed close to each other in the pillowcase they form a voluminous headrest pillow arrangement for supporting one side of a head or, alternatively, for forming a convenient cushion. Various diverse structures are contemplated for practicing the invention which, in addition to placing separate pillow units in the common pillowcase, include placing each pillow unit in a separate pillowcase and disposing one of the pillowcases within the other, or attached to the other.

The adjustable headrest and pillow of the invention is capable of use as such or in combination with a modified conventional disposable head cloth or sheet draped over the seat back of mass transportation vehicles.

12 Claims, 36 Drawing Figures

FIG. 8
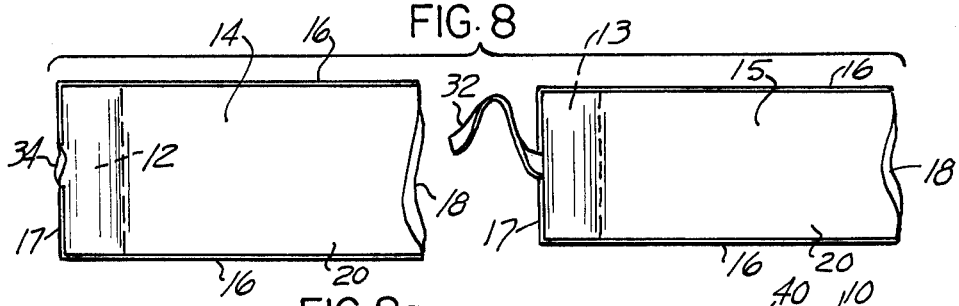
FIG. 8a
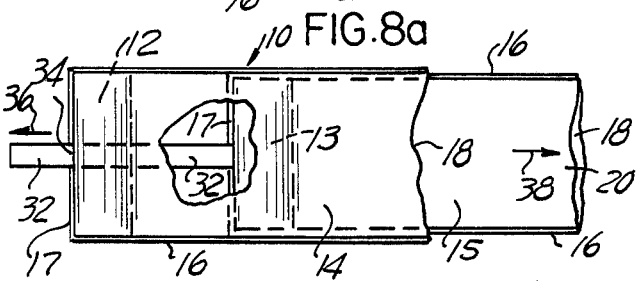
FIG. 9
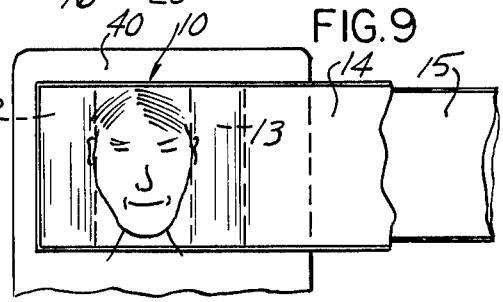
FIG. 10
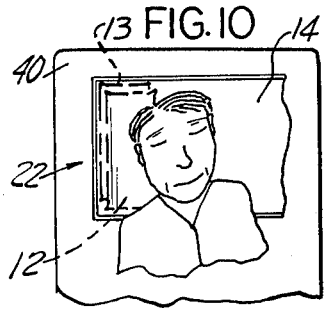
FIG. 11
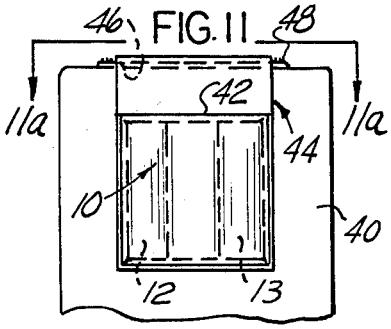
FIG. 11a
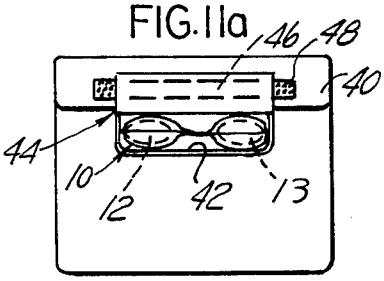
FIG. 12
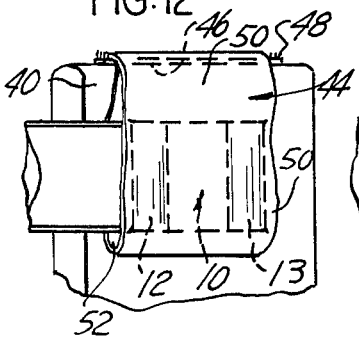
FIG. 13
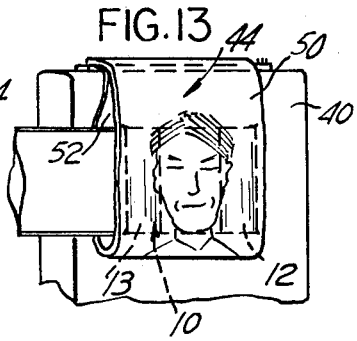
FIG. 15
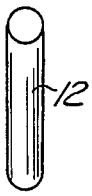
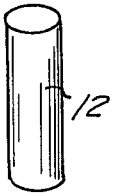
FIG. 16
FIG. 17
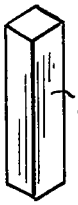
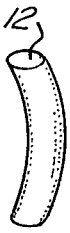
FIG. 18
FIG. 14
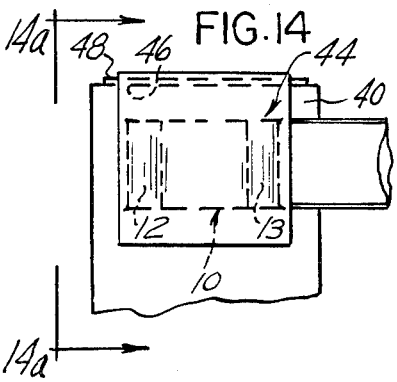
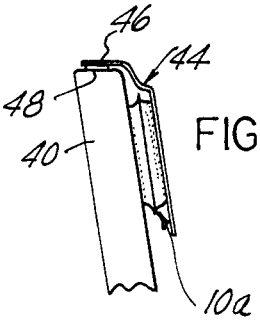
FIG. 14a
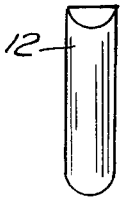
FIG. 19

DISPOSABLE ADJUSTABLE HEADREST AND PILLOW

BACKGROUND OF THE INVENTION

The present invention relates to a pillow-headrest arrangement for use with a seat and particularly for use by a passenger seated in a mass transportation vehicle, such as a railroad car, a bus, an airplane or even a passenger car.

It is common practice to drape over the back of the seat of railroad coach cars, intercity buses, and more particularly airplanes, a sanitary head cloth or sheet removably attached to the top of each seat back and draped over the front of the seat back to act as a clean and sanitary surface engaged by the back of the head of a passenger sitting in the seat. The head sheets are sometimes made of linen or fabric which are removed and laundered after each use, hopefully, and reused after having been laundered and sanitized. More often, the head sheets are made of relatively inexpensive linen or fabric-like paper material, and are disposed of as trash after use.

Diverse arrangements are provided for attaching the head sheet to the seat back, such as pins and safety pins, snaps, clips and the like. More conveniently, and more particularly in airplanes, the top of the seat back is provided with a band of the hook-type of pile or interlocking fabric, generally sold under the trademark "Velcro," and the head sheet is provided at an edge with a band of loop-type low cost Velcro material for removable attachment to the seat back band of hook-type Velcro material.

On some mass transportation vehicles, more particularly on airplanes, cushions are also readily available to the passengers or are distributed to the passengers by the cabin attendant. Such cushions are contentional in shape, are of relatively small size and are provided with a removable disposable case.

Most passengers are inclined to relax or sleep, more particularly on airplanes where space is somewhat cramped, reclining adjustment of the seat back is rather limited, and walking through the aisles is generally discouraged. However, it is somewhat difficult for most passengers to be able to assume a relaxed and comfortable position, in the rather confined space of the relatively narrow seats, and unless he is able to assume a position permitting him to support a side of his head back against a cushion, when asleep or when dozing, his head tends to wobble from side to side, which leads to irritating rapid successions of periods of rest and periods of full-awakedness. It will be appreciated that a seat back with an appropriate recess for the back of the head or with a built-in headrest may remedy some of the inconveniences of conventional straight back seats, such as, for example, providing a relatively firm support for the head preventing the head from wobbling. However, seats with headrests are not generally provided and, even if provided, they will still present some inconveniences as the position of the headrest is fixed when the headrest is built-in in the seat back.

SUMMARY OF THE INVENTION

The present invention provides a convenient, adjustable, removable, and partly or totally disposable headrest for vehicle passengers or even for ordinary household chairs, which is convertible to a cushion, if so desired, and which can be used either alone or in combination with the sanitary head sheet provided in mass transportation vehicles.

The present invention accomplishes its purposes by providing at least a pair of elongated resilient pillow units disposed removably in a single pillowcase or, alternatively, disposed each in a separate pillowcase, one of the pillowcases being placed within the other pillowcase or being adjustably attached thereto, with the result that the distance between the individual bolsters or supports provided by each pillow unit may be manually adjusted to the position most comfortable to the user. When wrapped together, in close proximity with each other or superimposed, the pillow units form a cushion. The adjustable headrest, or the cushion, thus provided, is capable of use alone, or in combination with a conventional head sheet or a modified head sheet.

The diverse objects and advantages of the present invention will become apparent to those skilled in the art when the following description of some of the best modes contemplated for practicing the invention is read in conjunction with the accompanying drawing wherein like numerals refer to like or equivalent parts, and in which:

BRIEF DESCRIPTION OF THE DRAWING

FIG. 8 is an exploded view of another modification of the present invention;

FIG. 8*a* is an elevation view of the structure of FIG. 8 in assembly;

FIG. 9 is a view schematically illustrating how the present invention may be used as a headrest;

FIG. 10 is a view illustrating how the present invention may be used as a head support or cushion;

FIG. 11 is a schematic front elevation view of a chair having its back provided with a head sheet modified for use with the present invention;

FIG. 11*a* is a top view from line 11*a*—11*a* of FIG. 11;

FIG. 12 is a schematic front elevation view of a seat back provided with a modified head sheet for use with the present invention;

FIG. 13 is a view similar to FIG. 12 but showing the invention in use;

FIG. 14 is a schematic elevation view of a seat back provided with a conventional head sheet in use with the present invention;

FIG. 14*a* is a side elevation view from line 14*a*—14*a* of FIG. 14; and FIGS. 15 through 19 are schematic perspective illustrations of diverse configurations for pillow units according to the present invention.

DETAILED DESCRIPTION OF THE PREFERRED EMBODIMENTS

Figures 1, 1A, 1B, 1C, 2, 2A, 3, 3A, 3B, 3C, 3D, 4, 4A, 4B, 5, 5A, 6, 6A, 7, 7A, 7B:
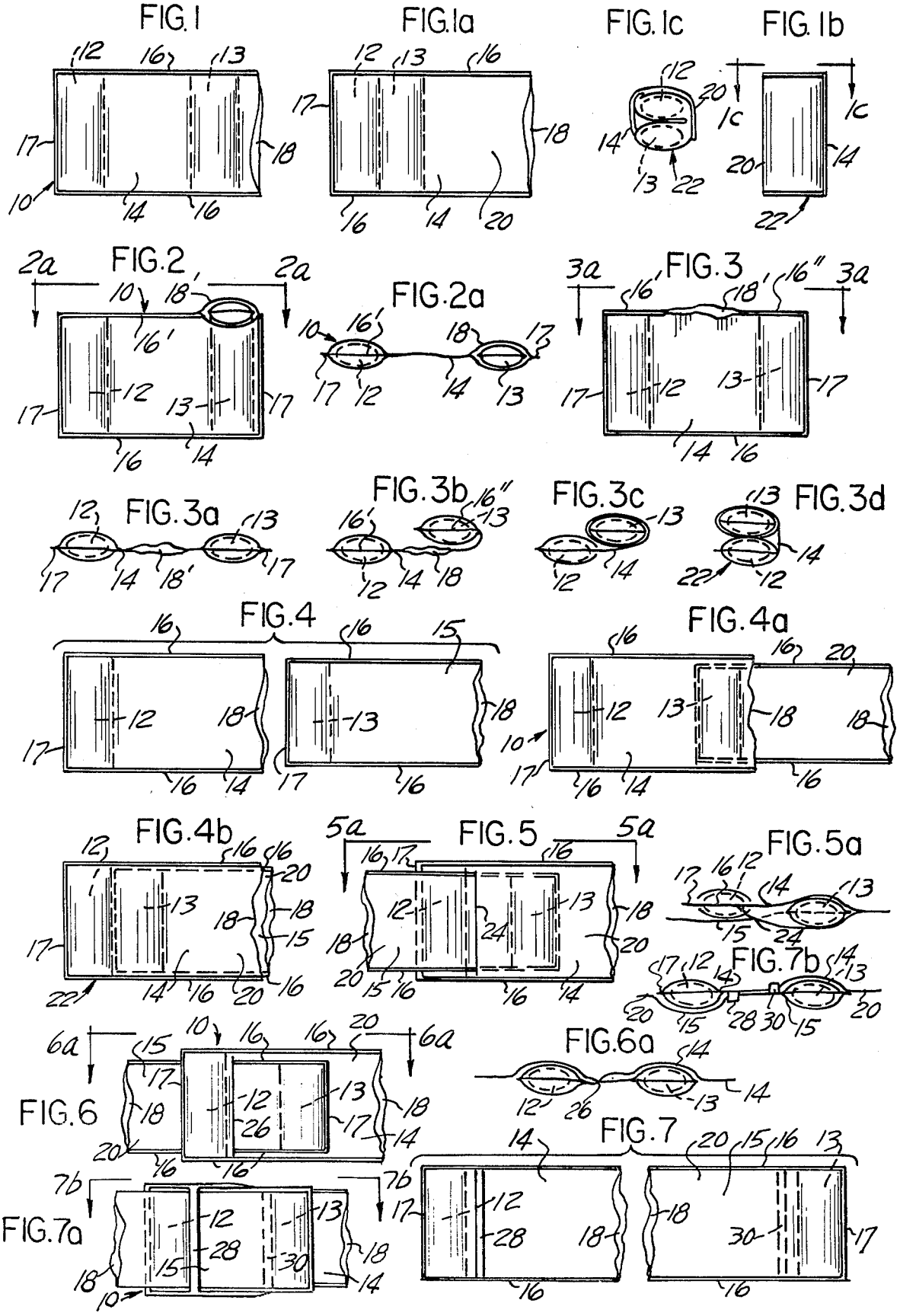
FIG. 1 is an elevation view of an example of headrest arrangement according to the present invention.
FIG. 1*a* is a view similar to FIG. 1 but showing how the headrest may be adjusted to form a pillow or cushion.
FIG. 1*b* is an elevation view of the structures of FIGS. 1*a*—1*a* shown in a modified pillow or cushion configuration.
FIG. 1*c* is a top view thereof from line 1*c*—1*c* of FIG. 1*b;*
FIG. 2 is a view similar to FIG. 1 but showing a modification thereof.
FIG. 2*a* is a top view thereof from line 2*a*—2*a* of FIG. 2.
FIG. 3 is a view similar to FIG. 2 but showing a further modification thereof.
FIG. 3*a* is a top view thereof from line 3*a*—3*a* of FIG. 3.
FIGS. 3*b*–3*d* are views similar to FIG. 3*a* and showing consecutive steps in adjusting the width of the headrest and forming a pillow.
FIG. 4 is an exploded view of a modification of the invention.
FIGS. 4*a* and 4*b* are illustrations of two different manners in which the structure of FIG. 4 may be used.
FIG. 5 is an elevational view of a further modification of the invention.
FIG. 5*a* is a view from line 5*a*—5*a* of FIG. 5.
FIG. 6 is a further modification of the invention.
FIG. 6*a* is a view from line 6*a*—6*a* of FIG. 6.
FIG. 7 is an exploded view of a further modification of the invention.
FIG. 7*a* is an illustration of the manner in which the structure of FIG. 7 may be used.
FIG. 7*b* is a top view from line 7*b*—7*b* of FIG. 7*a;*

Referring now to the drawing, and more particularly to FIG. 1 thereof, an example of adjustable headrest 10 convertible to a pillow or cushion takes the form of a pair of elongated cylindrical pillow units 12 and 13 removably placed in a pillowcase 14. The pillow units 12 and 13 are made of any appropriate soft, resilient or elastomeric material such as shredded paper, foamed polyurethane, foamed polyester, feathers, down, and the like. They may consist of a single piece molding, or of a fabric or plastic film bag filled with the resilient or elastomeric material. Although generally in the form of an elongated cylinder, they are made in any appropriate convenient shape, such as, for example, a right cylindrical straight shape, FIG. 15, a straight cylindrical shape, FIG. 16, of oval cross-section, a straight cylindrical shape having a square or rectangular cross-section, as shown at FIG. 18, a curved cylindrical shape as shown at FIG. 18, or a partial circular or oval shape of FIG. 19.

As illustrated at FIG. 1, the pillowcase 14 is substantially rectangular in shape, is closed on three sides, namely its opposite longer sides as shown at 16 and one of its shorter side, as shown at 17. The pillowcase 14 is open on one of its shorter sides, as shown at 18. The pillowcase 14 may be made of any one of a variety of material such as a soft woven cloth, as linen or the like, a soft non-woven paper sheet material, or a combination of woven paper and plastic strands, or it may be made of a plastic film or the like, such as the material used for making the removable disposable head sheet for mass transportation seats. The width of the pillowcase 14 is of a slightly larger dimension than the length of the pillow units 12 and 13. The closure 16 at the non-open sides is obtained by any convenient means, such as folding over the fabric, forming a seam, gluing, or the like. For the sake of convenience in the drawing, the closed sides of a pillowcase are arbitrarily represented by a double line, whether such closed sides, such as 16 at FIG. 1 are formed by folding over the fabric, seaming, gluing, or any other means.

It will be appreciated that, in the structure of FIG. 1, the pillow unit 13 can be reached through the open side 18 of the pillowcase 14, and may be manually positioned at any appropriate distance from the other pillow unit 12, as, for example, proximate to the other pillow unit 12, as illustrated at FIG. 1*a*. When disposed away from each other the pillow units 12 and 13 in the pillowcase 14 form a convenient headrest, for use as hereinafter explained. When disposed proximate to each other as in FIG. 1*a*, or even when superimposed over each other, they form a pillow or cushion. Furthermore, by folding the surplus portion or flap 20 of the pillowcase 14, and wrapping it around the portion of the pillowcase in which are placed the pillow units 12 and 13, a neatly wrapped pillow or cushion is formed, as illustrated at 22 at FIGS. 1*b* and 1*c*.

At FIGS. 2 and 2*a* there is shown a further modification of the invention wherein the pillowcase 14 is closed on one of its longer sides, as shown at 16 and on two opposite short sides, as shown at 17. The other long side is only partially closed as shown at 16', the remaining of that side being open, as shown at 18'. The pillow unit 12 is normally disposed at the bottom of the pocket formed in the pillowcase 14 by the closed long side 16, the closed short side 17 and the partially closed long side 16', and the other pillow unit 13 can be reached through the opening 18' and manually placed at any appropriate distance from the first pillow unit 12 for adjusting the width of the headrest. When disposed proximate to each other, or superimposed, the pillow units 12 and 13 form a pillow or cushion, as previously explained, and the surplus length of the pillowcase may conveniently be wrapped therearound, if so desired.

FIGS. 3–3*a* show a modification of the structure of FIGS. 2–2*a* consisting of the pillowcase being further closed at one of its longer sides, as shown at 16'', corresponding to the normal position of the pillow unit 13. Other than displacing the pillow unit 13 inside of the pillowcase 14 to any appropriate distance from the pillow unit 12 to adjust the width of the headrest 10, it may be more convenient to consider the pillow unit 13 as occupying a fixed position in the pillowcase, and to wrap around itself and around one of the pillow units the surplus portion of the pillowcase 14, as illustrated in consecutive steps at FIGS. 3*b* and 3*c*, for conveniently adjusting the width of the headrest. In the extreme position, with the empty surplus portion of the pillowcase 14 wrapped several times around one of the pillow units, as shown at FIG. 3*d*, a convenient pillow cushion is thus obtained.

FIGS. 4 through 4*b* illustrate a further modification of the invention, consisting of a pair of pillowcases 14 and 15, FIG. 4, each having both of its longer sides closed, as shown at 16, and one of its shorter sides also closed, as shown at 17. The other shorter side is open, as shown at 18, and a pillow unit 12 is disposed in the pillowcase 14 adjacent the shorter closed side 17, while a pillow unit 13 is disposed in the same manner in the pillowcase 15. In use, the pillowcase 15, with its pillow unit 13 disposed therein, is pushed through the open end 18 of the pillowcase 14, FIG. 4*a*, to any appropriate depth such as to form a headrest 10 having the pillowcase-contained pillow units 12 and 13 disposed at any convenient distance from each other. The surplus length 20 of the pillowcase 15 projecting from the pillowcase 14 may be tucked in the pillowcase 14 or folded backwards or forwards. If so desired, the pillowcase 15 can be pushed in the pillowcase 14 until the two pillow units 12 and 13 are adjoining each other or superimposed over each other, and the surplus flap 20 of each pillowcase wrapped around so as to form a cushion or pillow as previously explained.

Referring now to FIGS. 5–5*a*, there is shown a modification of the arrangement of FIGS. 4–4*b* wherein one of the pillowcases, for example pillowcase 14 is provided with a slit 24 in one of its sidewalls through which the surplus flap 20 of the pillowcase 15 is passed, after introducing the pillowcase 15 within the pillowcase 14 through the open end 18 of the pillowcase 14, the surplus flap 20 of the pillowcase 15 being thus passed first into the pillowcase 14 and then through the slit 24. In this manner, by pulling on the surplus flap 20 of each pillowcase, the distance separating the pillow units 12 and 13 may be adjustably decreased. If it is desired to increase the distance separating the two pillow units 12 and 13 such as to form a wider headrest 10, the user is able to reach through the open end 18 of the pillowcase 14, grasp the closed end of the pillowcase 15 in which is disposed the pillow unit 13, and pull the pillow units 12 and 13 away from each other, the surplus flap 20 of the pillowcase 15 retracting within the pillowcase 14 through the slit 24.

In the arrangement of FIGS. 6–6*a*, the two pillowcases 14 and 15 are placed one behind the other, and the free surplus flap 20 of the pillowcase 15 is passed through a pair of aligned slots 26 formed through the opposite walls of the pillowcase 14. The distance separating the pillow units 12 and 13, each disposed at the bottom or closed end 17 of its respective pillowcase, can be manually adjusted by pulling either on such closed ends to move the pillow units away from each other or pulling on the free surplus flap 20 of the pillowcases 14 and 15 to move the pillow units 12 and 13 closer to each other.

FIGS. 7–7*b* illustrate a further modification of the invention wherein the pillowcases 14 and 15 are each provided on one side with a strap 28 or 30, respectively, each strap 28 or 30 having its ends attached to the longer closed side 16 of the respective pillowcase 14 or 15 and being disposed proximate the respective pillow units 12 and 13 tucked in the closed end of the pillowcases 14 and 15, respectively. In use, as shown at FIGS. 7*a* and 7*b*, the free surplus flap 20 of the pillowcase 15 is passed under the strap 28 attached to the pillowcase 14, while the free surplus flap 20 of the pillowcase 14 is passed under the strap 30 attached to the pillowcase 15. For bringing the pillow units 12 and 13 closer to each other, it is only necessary to pull on the free surplus flaps 20 of both pillowcases 14 and 15. To move the pillow units 12 and 13 away from each other, they are simply pulled away from each other by grasping the pillow units.

The structure of FIGS. 8–8*a* also comprises a pair of pillowcases 14 and 15, the pillowcases 14 containing the pillow unit 12, while the pillowcase 15 contains the pillow unit 13. Each pillowcase 14 and 15 is closed on its two longest sides, as shown at 16 and on one of its shorter sides, as shown at 17. However, one of the pillowcases, pillowcase 15 for example, is provided with a pull strap 32 having an end attached to its shortest closed side 17 which, in use and as best shown at FIG. 8*a*, is passed through a slot 34 formed in the shorter closed side 17 of the pillowcase 14, after the pillowcase 15 has been pushed through the open end 18 of the pillowcase 14. Consequently, by pulling the pull strap 32 in the direction shown by arrow 36, the pillow units 12 and 13 are brought closer together and, by pulling on the free flap 20 of the pillowcase 15, in the direction of arrow 38, the two pillow units 13 and 12 are adjusted away from each other.

FIGS. 9 and 10 illustrate the manner by which the adjustable headrest of the invention convertible to a pillow cushion may be used by a person sitting in a chair, such as a mass transportation vehicle seat having a back 40. At FIG. 9, an adjustable headrest 10 according to the present invention is being shown in use, behind the head of a person, disposed between the back of that person's head and the surface of the seatback 40. Although the adjustable headrest 10 of FIG. 9 is structurally substantially like the embodiment of the present invention shown hereinbefore and described relative to FIGS. 4–4*b*, it will be readily apparent that any one of the embodiments of the invention hereinbefore described could be used in the same manner. The pillow units 12 and 13 have been manually adjusted to a distance that the user found most convenient for providing a support for the sides of the back of his head, and the headrest 10 is held in position simply as a result of the pressure exerted by the user's head back against the upholstery of the seat back 40. At FIG. 10, the two pillow units 12 and 13 have been tucked together or superimposed, such as to form a cushion or pillow 22 for a side of the head of the user.

FIGS. 11–11*a* schematically illustrate another manner in which a headrest 10, according to the present invention, can be used placed in a pocket 42 formed in a modified back sheet 44 for a seat back 40. The back sheet 44 is provided on its rear surface proximate its top edge with a strip of Velcro material which is adhered to a complementary strip 48 of Velcro material attached to the top of the seat back 40.

FIG. 12 shows another modified head sheet 44 formed of a length of appropriate fabric or fabric-like material folded over in the form of a loop having two portions 50 and 52 connected at their edge where it is provided with a strip of Velcro material 46 for attachment to the Velcro material strip permanently attached to the top of the seat back 40. Inside of the loop formed by the two portions 50 and 52 of the head sheet 44, a headrest 10, according to the present invention, is held in position with the appropriately adjusted pillow units 12 and 13 for forming a comfortable head back support.

FIG. 13 illustrates the arrangement of FIG. 12 while being used.

FIGS. 14–14*a* illustrate an adjustable headrest 10 according to the present invention placed behind a conventional single sheet head sheet 44. The headrest 10 has been tucked under the head sheet 44 and is held in position securely when a person applies the back of his head against the head sheet 44, with the headrest 10 disposed at any convenient location and adjusted to any convenient width. It has been observed that even when the person sitting in the seat disengages the back of his head from the outer surface of the head sheet 44, there is enough friction between the rear surface of the head sheet 44 and the surface of the pillowcase of the headrest 10 to maintain the headrest in position between the rear surface of the head sheet 44 and the surface of the seat back 40.

Having thus described the present invention by way of typical structural embodiments thereof, modification whereof will be apparent to those skilled in the art, What is claimed as new is as follows:

1. A disposable adjustable headrest comprising in combination a rectangular pillowcase closed on its two longer sides and on one of its shorter sides, said pillowcase being open on one of its shorter sides, and two relatively narrow elongated separate resilient pillow units, said pillow units being removably and independently disposed freely in said pillowcase normally substantially parallel to each other, one of said pillow units being manually displaceable relative to the other from proximate thereto to substantially away therefrom, one of said pillow units being positioned proximate the shorter closed side of said pillowcase and extending along said one shorter closed side between the two other closed longer sides of said pillowcase, and said pillowcase having a length substantially greater than the combined width of said pillow units and a width snuggly accepting said pillow units when said one of said pillow units is positioned proximate said one shorter closed side of said pillowcase and the other of said pillow units is disposed substantially parallel to said one of said pillow units, whereby the other of said pillow units is accessible through said open shorter side of said pillowcase for manual adjustment proximate to and away from said one of said pillow units.

2. A disposable adjustable headrest comprising in combination a pillowcase closed on three sides and open at least partially on a fourth side and two relatively narrow elongated separate resilient pillow units, said pillow units being removably and independently disposed freely in said pillowcase normally substantially parallel to each other, one of said pillow units being manually displaceable relative to the other from proximate thereto to substantially away therefrom, at least one of said pillow units being positioned proximate one of said closed sides of said pillowcase and extending along said one closed side between the two other closed sides of said pillowcase, and said pillowcase having a length greater than the combined width of said pillow units and a width snuggly accepting said pillow units when one of said pillow units is positioned proximate said one closed side of said pillowcase with the other of said pillow units disposed substantially parallel to said one pillow units, wherein said pillowcase is substantially rectangular and is closed on its two shorter sides and on one of its longer sides, the other of said longer sides is partially closed and partially open, and said pillow units are accessible through said partially open side.

3. The headrest of claim 1 wherein said other of said pillow units is disposed in a second rectangular pillowcase, said second pillowcase is closed on its two longer sides and closed on one of its shorter sides, said other of said pillow units is disposed snuggly in said second pillowcase at said shorter closed side and said second pillowcase is placed in said first mentioned pillowcase.

4. The headrest of claim 3 wherein said first mentioned pillowcase has a slit disposed proximate said one of said pillow units and said second pillowcase has a portion provided with said shorter open side passed through said slit.

5. The headrest of claim 3 wherein said second pillowcase has a pull strand attached to said shorter closed side and said first mentioned pillowcase has a slit formed at said shorter closed side through which said pull strand is passed.

6. The headrest of claim 1 wherein said one of said pillow units is disposed in said pillowcase and said other of said pillow units is disposed in a second rectangular pillowcase, said second pillowcase being closed at its longer sides and at one of its shorter sides, and said first mentioned pillowcase has a pair of opposite slits disposed proximate said one of said pillow units through which is passed the end of said second pillowcase containing said other of said pillow units and provided with said shorter open side.

7. The headrest of claim 1 further comprising a head sheet attached to the back of a seat and supporting said headrest.

8. The headrest of claim 7 wherein said head sheet is provided with a pocket receiving said headrest.

9. The headrest of claim 7 wherein said head sheet is in the form of a folded over sheet of pliable material, said headrest being disposed within said folded sheet.

10. The headrest of claim 2 further comprising a head sheet attached to the back of a seat and supporting said headrest.

11. The headrest of claim 10 wherein said head sheet is provided with a pocket receiving said headrest.

12. The headrest of claim 10 wherein said head sheet is in the form of a folded over sheet of pliable material, said headrest being disposed within said folded sheet.

* * * * *